United States Patent [19]

Hansmeyer

[11] 4,214,570

[45] Jul. 29, 1980

[54] HEATING SYSTEM

[76] Inventor: Kenneth Hansmeyer, 1011 W. Tecumseh Rd., Norman, Okla. 73069

[21] Appl. No.: 889,201

[22] Filed: Mar. 23, 1978

[51] Int. Cl.[2] ..... F24B 7/00

[52] U.S. Cl. ..... 126/121

[58] Field of Search ..... 126/121, 120

[56] References Cited

U.S. PATENT DOCUMENTS

| | | | |
|---|---|---|---|
| 2,705,488 | 4/1955 | Wright | 126/121 |
| 2,707,464 | 5/1955 | Gillen | 126/121 |
| 3,724,443 | 4/1973 | Carson | 126/121 |
| 3,749,078 | 7/1973 | Dupler | 126/121 |
| 3,762,391 | 10/1973 | Andrews | 126/121 |
| 4,010,728 | 3/1977 | Hempel et al. | 126/120 |

*Primary Examiner*—Samuel Scott
*Assistant Examiner*—Wesley S. Ratliff, Jr.
*Attorney, Agent, or Firm*—William R. Laney

[57] ABSTRACT

A system for heating an edifice comprising a firebox, means for closing a fuel access opening to the firebox, a combustion air passageway opening into the firebox and extending to the outside of the edifice, and a stack connected to, and projecting vertically from, the firebox to convey combustion gases therefrom. A baffled air plenum chamber surrounds the firebox and a portion of the stack and is defined by a housing forming an enclosure around the firebox and stack. An upper air opening into the air plenum chamber is disposed at the upper side of the housing, and a plurality of lower air openings are disposed in the housing on opposite sides of the firebox, and are spaced downwardly from the upper opening. A hot air discharge opening from the air plenum chamber is provided in the side of the housing near the bottom thereof, and cooperates, through its spaced position in relation to the upper and lower air openings, with internal baffling provided in the air plenum chamber to proportionately mix air from the upper and lower air openings, and to selectively optimize the temperature of air discharged from the air plenum chamber through the hot air discharge opening. Ducting connects the air discharge opening to a conventional central heating system. Doors are provided for closing the fuel access opening to the firebox, and a cool air curtaining subassembly is provided to continuously and automatically cool these doors during operation of the system.

13 Claims, 6 Drawing Figures

HEATING SYSTEM

BACKGROUND OF THE INVENTION

1. Field of the Invention

This invention relates to fireplace systems which more efficiently and safely deliver heat to the interior of the edifice in which they are located by heat exchange with air circulated within the building as the air is passed through a confining air plenum and in contact with a firebox forming part of the system.

2. The Prior Art

Since wood is an ancient fuel of man and has been used for milleniums to provide heat and light to the human race, numerous ways have been devised for improving the aesthetic effect of the burning wood, and, more recently, a great variety of attempts have been made to more efficiently recover and utilize the thermal energy developed by the wood during burning. The term "recent," of course, in the context of the discussion of man's use of wood for heat and light, encompasses at least the last one or two centuries. The quest for improved ways of recovering the heat energy from burning wood has been intensified yet more recently as a result of the projected depletion of fossil fuel supplies, and particularly, natural gas and petroleum.

Endeavors have been made to retain and permit enjoyment of the aesthetic experience of a blazing wood fire in an open fireplace before which the occupants of a home may sit, while gaining more efficient heating of the home. In so doing, various proposals have been advanced for recapturing from the hot combustion gases developed as the wood burns, a larger portion of the thermal energy in such gases prior to the time that they are vented to the atmosphere through the chimney or flue, and the residual energy contained therein is lost. For many decades now, the concept of taking a portion of the air inside the house, drawing it across the heated external surfaces of the firebox, and then returning it to one or more locations in the house has been in the minds of men, and has been accomplished through various physical structures. In probably the most simple of these, and one still in use, air returns are provided at a location near the bottom of the firebox, and frequently on opposite sides thereof, and this air is then permitted to pass, through natural circulation and the ascendant characteristic of hot air, upwardly around the sides of the firebox and then out through one or more vents located near the top of the firebox, and opening into the same room from which the air is initially extracted. While this arrangement probably recovers a small portion of the heat which would otherwise be carried out through the flue with the combustion gases, the percentage of recovery is not large, and such systems do nothing towards providing heat to the remainder of the house other than the room in which the fireplace is located.

A number of variations on the concept of providing air returns adjacent the firebox and then conveying air in heat exchange relation to the firebox and passing it to one or more locations in the house have been proposed, and some of these have been utilized. One of the older U.S. patents which proposes to provide an air plenum around the firebox for purposes of heat exchange and recovery of a portion of the thermal energy from the hot stack gases is Coulter U.S. Pat. No. 192,416. More recently, Glover U.S. Pat. No. 3,384,619 describes a system which includes, in combination, a fireplace and a forced air conventional central furnace system. The fan or blower of the conventional central heating system is used for circulating air heated by the fireplace at a time when the fireplace is in use. If the temperature drops below an established thermostat setting, the furnace is activated to further heat the circulated air.

Other systems which have proposed to pass the return air within the home or building in close proximity to the firebox, followed by recirculation of the heated air, include U.S. Pat. Nos. 2,791,213; 2,393,812; 4,015,581; 4,206,264; 3,976,047; 3,999,535, and 3,085,564. In the latter two patents, the heated air is connected into a system which integrates the central heating system of the edifice for use when the fireplace is not employed.

In addition to the foregoing and numerous other patented and unpatented proposals for circulating the air into heat exchange proximity to the firebox of the fireplace for purposes of more efficiently burning and utilizing wood, a number of proposals have been advanced, and many patented, for controlling the rate of combustion so as to enhance or at least more closely control the temperature at which the wood is burned in the fireplace, and the time over which it is consumed. In this regard, the manner in which combustion air is introduced to the burning wood has been variously altered, with one proposal being to bring outside air into the firebox at a location beneath or to the rear of the wood, with a dampering system used to control the flow of outside air thus admitted. This has the advantage of providing a source of draft air of low carbon dioxide content without drawing the warm air from the interior of the house for purposes of combustion with subsequent heat loss through the stack or flue. Patents which generally illustrate or describe this type of combustion air source include U.S. Pat. Nos. 2,343,812; 2,409,731; 4,026,263; 3,981,292, and 3,926,174.

Frequently, in conjunction with controlled combustion air drawn from either outside or inside the house, a dampering effect and prevention of internal air loss will be accomplished by providing one or more closure means, such as glass doors, which can be closed across the open front of the fireplace to prevent the air within the room into which the fireplace opens from passing freely up the chimney. The doors also prevent the occurance of excessive draft which will result in too rapid consumption of the wood and excessive heat loss. Such glass doors often are utilized in pairs which open in opposite directions to expose the mouth or open interior of the fireplace. Typical patents illustrative of this construction include U.S. Pat. Nos. 4,026,264; 4,015,581; 3,965,886; 4,004,731; 3,976,047, and 3,976,048.

BRIEF DESCRIPTION OF THE PRESENT INVENTION

It is believed that the present invention provides a highly useful and not previously discerned or apparent means for improving the way in which a wood-burning open front fireplace can be used to heat the air inside a building, and by which a major portion of the total thermal energy of the burning wood can be recovered. Moreover, and quite importantly, the fireplace system of the present invention provides safeguards against possible overheating of surrounding structures, with resulting fire, by preventing passage into the ducting used to convey the air heated by the fireplace to outlying rooms of any air which exceeds about 250° F. in temperature.

Broadly described, the fireplace heating system of the invention comprises a firebox having opposed side walls, a back wall and a fuel access opening at the front of the firebox. A combustion air passageway opens into the firebox at the rear wall, and is adapted to extend to the outside of the home or edifice in which the firebox is located, and an angulated stack projects vertically from the firebox to convey combustion gases upwardly therefrom. A baffled air plenum chamber surrounds the firebox, and is defined by a housing which includes a closure cover or top plate adjacent and sealingly surrounding the stack, and further includes an upper portion, a frusto-pyramidal central portion, and a bottom or base portion. Each of these portions of the housing includes side plates and a back plate, and the central and upper portions of the housing also each include a front plate. The upper front plate in the upper portion of the housing defines an upper air opening which opens into the air plenum chamber. A plurality of lower air openings are disposed in the base portion of the housing on opposite sides of the firebox, and are in substantially horizontal alignment with each other. The lower openings are spaced downwardly from the upper air opening. A heated air discharge opening is provided in a side of the air plenum chamber in the base portion of the housing and cooperates, through its spaced position in relation to the upper and lower air openings, with internal baffling provided in the air plenum chamber to proportionately mix air from the upper and lower air openings, and to selectively optimize the temperature of air discharged from the air plenum chamber through the heated air discharge opening.

In a preferred embodiment of the invention, structure is included for establishing and maintaining a curtain of cool air along and against the inside surfaces of closure doors utilized for closing the fuel access opening of the firebox.

An important object of the invention is to provide a fireplace heating system which will heat and circulate air to the dwelling in which it is located without overheating such air to prevent a fire hazard.

An additional object of the invention is to provide a fireplace heating system which minimizes draft of internal air from a dwelling in which it is located.

Another object of the invention is to prevent the glass plates in closure doors used at the front of a fireplace from becoming sooted and smoke-fouled.

A further object of the invention is to provide a glass-doored fireplace system which automatically and continuously cools glass doors provided at the firebox fuel opening to prevent serious burns resulting from inadvertent touching of the doors.

Additional objects and advantages will become apparent from the following detailed description of a preferred embodiment of the invention when the same is considered in conjunction with the accompanying drawings which illustrate the invention.

GENERAL DESCRIPTION OF THE DRAWINGS

DETAILED DESCRIPTION OF A PREFERRED EMBODIMENT OF THE INVENTION

Figure 1:
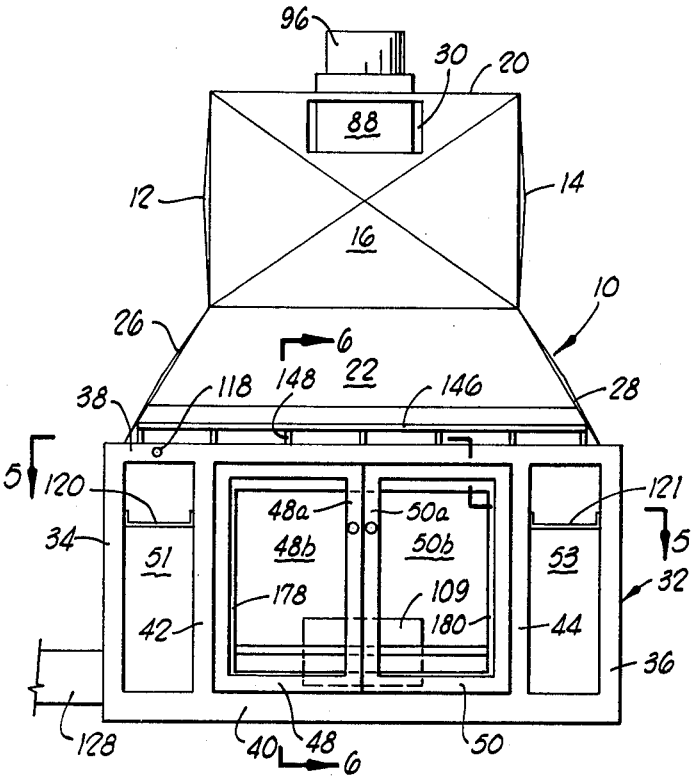
FIG. 1 is a front elevation view of the heating system of the present invention.

Referring initially to FIG. 1 of the drawings, a fireplace assembly constructed in accordance with the present invention is illustrated. The fireplace assembly includes an outer housing, designated generally by reference numeral 10. The outer housing includes an upper portion formed by a pair of opposed upper side walls 12 and 14, an upper front wall 16, and an upper back wall 18. Forming a closure at the upper side of the housing is a top plate 20. The upper side walls 12 and 14, upper front and back walls 16 and 18 and top plate 20 form a generally rectangular parallelepiped. The upper portion of the housing 10 is disposed immediately above a frusto-pyramidal central housing portion made up of a trapezoidally shaped front wall 22, a back wall 24 and a pair of inwardly inclined side walls 26 and 28. The central portion of the housing 10 communicates with the hollow interior of the upper portion thereof to define a chamber forming a part of an air plenum space as hereinafter described. In the central upper portion of the upper front wall 16 of the housing 10, a relatively large rectangular air opening 30 is provided. The opening 30 may be partially closed with vents or louvers, and may, in some circumstances, be a dampered opening which can be varied in its areal size for reasons hereinafter explained.

The fireplace system of the invention further includes a base section or portion of the housing 10 designated generally by reference numeral 32. The base section 32 includes a frame which has a pair of opposed, outer, vertically extending substantially parallel frame members 34 and 36 which are joined at their respective upper and lower ends by a pair of transverse frame members 38 and 40, respectively. Extending between the upper and lower transverse frame members 38 and 40 and spaced inwardly from the outer frame members 34 and 36 are a pair of vertically extending parallel intermediate frame members 42 and 44.

A large central firebox opening is located at the forward side of the base portion 32 of the housing 10 and is defined or framed by the frame members 38, 40, 42 and 44. The firebox opening is closed by a pair of pivotally mounted doors 48 and 50, which doors are provided with transparent panels of glass or other suitable material.

To the outer side of the respective frame members 42 and 44, and defined between these members and the adjacent outer frame members 34 and 36, openings or spaces 51 and 53 are provided which can suitably be covered by a suitable grille, louver, or any other aesthetic structure through which air can pass. At the rear side of the base portion 32 of the housing 10, rear outer frame members 54 and 56 are provided and are interconnected at their upper ends by lower transverse frame member 60. The frame members 38 and 40 are joined or interconnected by horizontally extending top plates 62 and 64 which are located on opposite sides of a firebox 65 which is provided centrally within the base portion, and is constructed to include opposed, substantially parallel side walls 66, a rear or back wall 68 which interconnects the side walls and a bottom or floor plate 69 which can be suitably covered with firebrick 71. A floor plate 61 is provided at the bottom of the base portion 32 of the housing 10 around the firebox 65 and is secured at its outer edges to frame members 40 and 60 (see FIGS. 2 and 4). The firebox 65 is mounted between the frame members 42 and 44 so that the open forward side of the firebox is aligned with the opening between the frame members 42 and 44 which is closable by the pivotably supported doors 48 and 50.

At its upper side, the firebox 65 is open and communicates with a stack which includes a frusto-conically shaped lower stack portion, designated generally by reference numeral 70. The lower stack portion 70 includes a forwardly sloping, upwardly extending rear wall 72, a rearwardly sloping, upwardly extending forward wall 74 and a pair of opposed, inwardly sloping, upwardly extending opposed side walls 76. A short intermediate stack portion 78 projects upwardly from the lower stack portion 70, and includes front and back walls 80 and 82 and a pair of opposed substantially parallel side walls 84.

The intermediate stack portion 78 is connected to a rearwardly and upwardly extending upper stack portion designated generally by reference numeral 86 which includes a front wall 88, a back wall 90 and a pair of side walls 92. It will be noted that the upper stack portion extends in a direction away from the upper air opening 30 in the housing 10, and that the front wall 88 is in direct alignment with this upper air opening. The upper stack portion 86 is connected to a connecting sleeve 94 disposed at the lower end of a flue pipe 96. The upper end portion of this flue pipe, which is not illustrated, extends, in conventional fashion, upwardly through the roof of the home or other edifice in which the fireplace assembly is located.

It will be noted in referring to the drawings that the upper and central portions of the housing 10 are positioned around the lower, intermediate and upper stack portions, and rest upon the base portion 32 of the housing so as to define a portion of an air plenum chamber which surrounds the stack and firebox 65 and is enclosed within the housing. Forming a part of the air plenum chamber is a space defined between the rear wall 68 of the firebox 65 and a lower rear housing plate 98 which projects downwardly in vertical alignment with the plate 24 of the central housing portion. There also is provided a pair of opposed, substantially parallel side plates 100 which are spaced outwardly from the side plates 66 of the firebox, and extend between the frame plates 34 and 36 at the front of the base portion 32, and the frame plates 54 and 56 at the rear thereof. The side plates 100 thus define with the side plates 66 of the firebox 65, additional spaces located at opposite sides of the firebox and forming a part of the air plenum chamber defined within the housing 10 as hereinbefore described.

Figure 3:
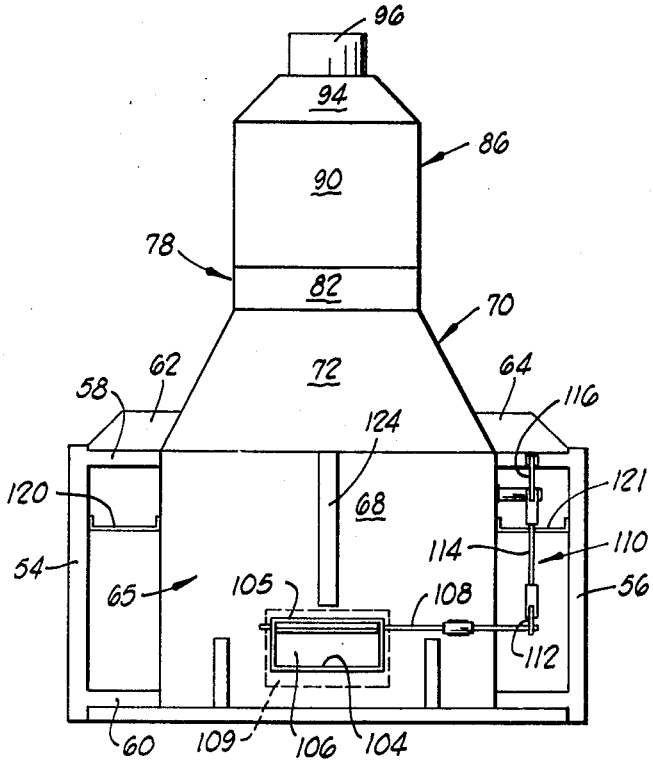
FIG. 3 is a rear elevation view of the firebox and stack forming a portion of the heating system of the invention and showing a part of the framework forming a base portion of a housing which surrounds the firebox and stack.

It will be noted in referring to FIGS. 1 and 3 that the rear plate 68 of the firebox 65 has a combustion air or draft opening 104 provided therethrough near the lower side of this plate. An air channel, as defined by a duct 105, communicates with the opening 104 and functions to convey air from outside the dwelling through the rear wall 98 and into the firebox. The combustion air opening 104 serves to admit this outside air to the lower rear portion of the firebox 65 for purposes of supporting the combustion of wood burning therein.

The opening 104 is selectively opened to a controlled degree by means of a damper plate 106 which is mounted on a supporting rod 108 pivotably extended through the duct 105. Rotation of the rod 108 is effected by a manually manipulatable linkage designated generally by reference numeral 110 and hereinafter described. The fully open position of the damper plate 106 is illustrated in dashed lines in FIG. 4.

Figure 4:
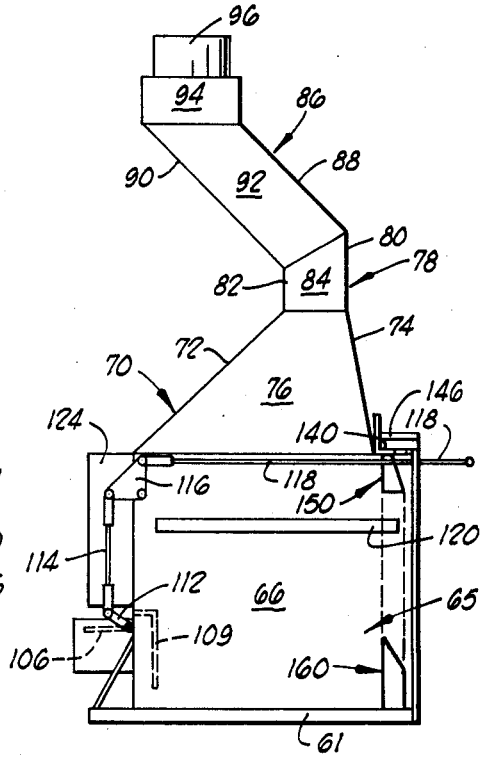
FIG. 4 is a side elevation view of the firebox, stack and framework structure shown in FIG. 3.

Mounted rigidly on the inner side of the firebox 65 and projecting inwardly then downwardly from the back wall 68 is an air diverting plate 109 as shown in dashed lines in FIG. 4. The air diverting plate 109 functions to deflect and divert air entering the opening 104 to opposite sides of the firebox, and in a circuitous path around the fuel located in the firebox.

The control linkage 110 by which the position of closure of the damper plate 106 is adjusted and controlled includes, in addition to the rod 108, a toggle link 112 which is connected to one end of the rod 108 and is pivotally connected to a vertically extending rod 114 attached to one corner of a triangular pivot plate 116. A second corner of the pivot plate 116 is pivotally attached to the side wall 66 of the firebox 65, and a third corner is connected to a manually reciprocable control rod 118 which extends horizontally through an opening formed in the top frame member 38 at the forward side of the base portion 32 of the housing 10.

Figure 2:
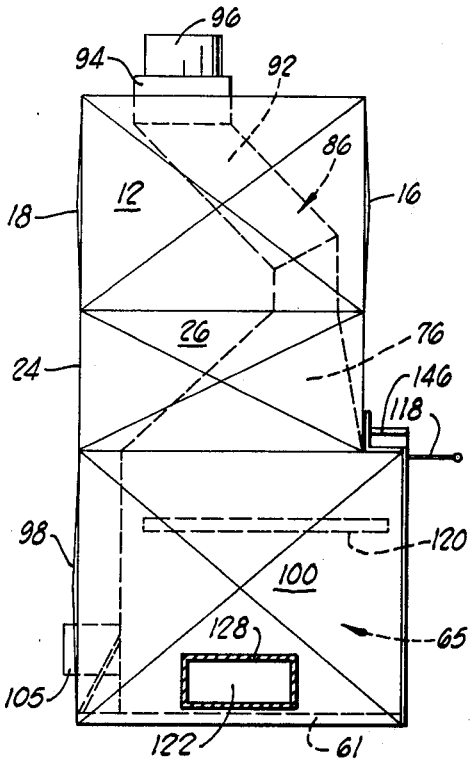
FIG. 2 is a side elevation view of the heating system of the invention.

Located between one side plate 100 of the housing base portion 32 and one of the side walls 66 of the firebox spaced therefrom is a horizontally extending, relatively short baffle plate 120. A corresponding, relatively longer second baffle plate 121 extends between the opposite side wall 66 of the firebox 65 and the facing outer side plate 100 of the housing base portion 32. As best shown in FIGS. 2 and 4, the horizontally extending baffle plates 120 and 121 terminate inwardly from the forward side of the base portion 32. The baffle plate 120 also terminates at a location which is spaced inwardly within the air plenum chamber from the back wall 98 of the housing 10, while the baffle plate 121 extends substantially further rearwardly than does the baffle plate 120. It will also be noted in referring to FIG. 1 that the baffle plates 120 and 121 are in substantially coplanar alignment in a horizontal plane spaced upwardly from a heated air discharge opening 122 hereinafter described. The baffle plates 120 function to deflect or direct air flow moving upwardly or downwardly within the air plenum chamber into a horizontal path of flow alongside the firebox 65. It will be noted that air which enters the upper air opening 30 in the upper forward plate 16 at the upper portion of the housing 10, after moving downwardly in the air plenum chamber, is directed rearwardly and to the rear of the firebox. It then moves through the space at the rear of the firebox and around to the left side of the firebox as the structure is viewed in FIG. 1. Ultimately, air leaves the air plenum chamber through a heated air discharge opening 122 which is provided in the central portion of the wall 100 near the bottom plate 61.

At the rear side of the firebox 65 and secured to the rear wall 68 thereof, a vertically extending plate 124 is provided and extends from the rear wall 68 to the lower rear housing plate 98 of the housing 10, thereby partitioning the upper portion of the space between these walls or plates. In this way, air which enters the opening 53 at the right side of the firebox 65 (as it is viewed in FIG. 1) and passing toward the rear over the baffle plate 120 is then directed downwardly around the baffle plate 124 so as to merge with air passing through the air plenum chamber as a result of entry into the upper portion thereof through the air opening 30 at the top of the housing 10.

The heated air discharge opening 122 illustrated in FIG. 2 is connected to a duct 128 as illustrated in FIG. 1, which duct is ultimately connected to the conventional central heating duct system normally installed in a dwelling. Appropriate thermostatic controls (not shown) then permit plenum chamber air which has reached a certain predetermined temperature to pass through the opening 122 and into the duct 128 for subsequent conveyance into the central heating system of the dwelling. When the fireplace is not in use, or when the air in the air plenum chamber has not been sufficiently heated, the conventional furnace provided with the central heating system in accordance with well known prior art construction techniques is energized to provide the heat necessary to heat the dwelling.

An advantage of the present invention is the manner in which the air flow through the air plenum chamber is controlled so as to obtain maximum heat transfer to this air for conveyance through the duct 128 to the house, and therefore more efficiently utilize the burning wood, all while maintaining the temperature of the air as thus heated at a safe level. Thus, the system functions to prevent air from passing through the heated air discharge opening 122 and into the ducting 128 at a temperature which exceeds about 250° F. Any hazard which might otherwise arise from overheating the air conveyed through the duct 128 to the central heating system is thus obviated.

The spaces to be heated within the dwelling are, of course, thermostated to provide maximum comfort, and when sufficient warmth is present in these spaces, the central heater fan is inactivated and no air flows through the discharge opening 122 into the duct 128.

Another important feature of the present invention is structure provided for the purpose of cooling the forward side of the base section 32, and particularly, the intermediate frame members 42 and 44 thereof, and the doors 48 and 50. The doors 48 and 50 preferably include rectangular steel frames **48*a* and 50*a* respectively, which support glass panels 48*b* and 50*b* interiorly thereof. The radiant heat from the fire tends to heat the doors 48 and 50**, including the steel frames and glass panels, to a very high temperature, thus presenting a safety hazard to persons near the fireplace who inadvertently touch the glass panels or steel frames.

For the purpose of maintaining the glass panels and steel frames of the doors 48 and 50 in a relatively cool condition when they are closed during operation of the heating system of the invention, and for certain other important functions hereinafter described, an ambient air cooling system is provided which continuously directs a curtain of relatively cool air along the inner sides of the doors, and interposes such curtain between the doors and the wood burning in the fireplace. To this end, an elongated closure panel 140 is extended along the upper side of the base section 32, and at the forward side of the front wall 22 of the outer housing 10. A part of the elongated closure panel 140 functions in conjunction with the side plates 100 and lower rear housing plate 98 to close the lower portion of the air plenum chamber around the firebox 65, and a central portion thereof extends directly over the opening at the forward side of the firebox.

Figure 5:
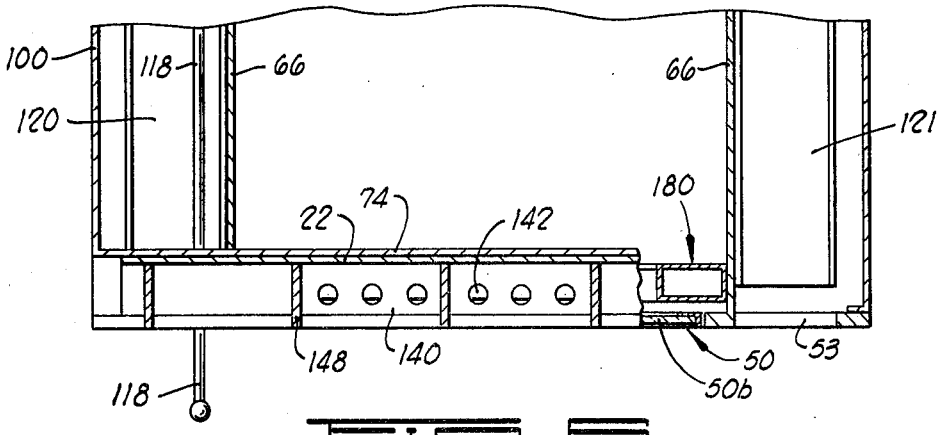
FIG. 5 is a sectional view taken along line 5—5 of FIG. 1.
Figure 6:
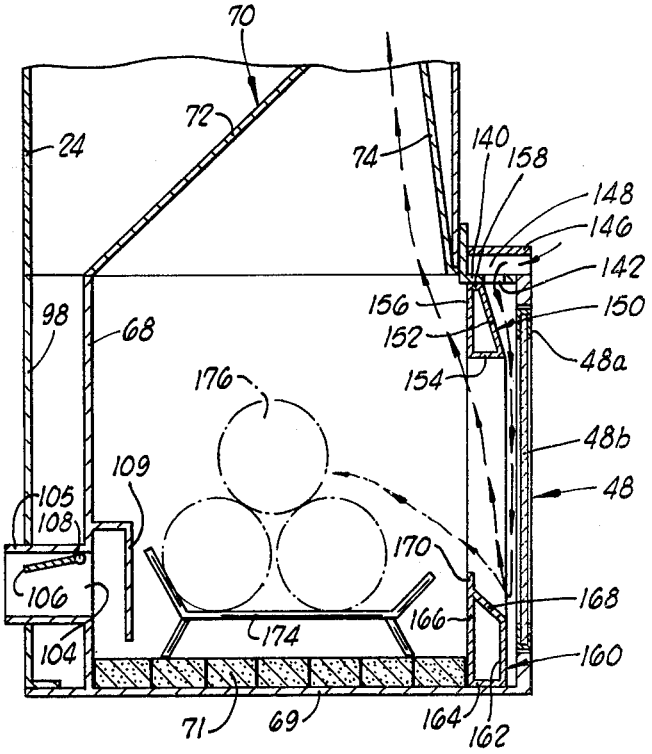
FIG. 6 is a sectional view taken along line 6—6 of FIG. 1.

A series of longitudinally spaced holes or apertures 142 are formed through the elongated panel 140 as shown in FIGS. 5 and 6, and extend from a location which is at the meeting inner side edges of the doors 48 and 50 when they are closed outwardly to points about halfway across each of these doors. It will thus be seen that positioning of the holes 142 in the elongated panel 140 is such that air passing through these holes is directed downwardly at a location immediately to the rear of the doors 48 and 50.

To aid in directing the air, and also for aesthetic reasons, a cover plate 146 is positioned over, and extends substantially parallel to, the elongated panel 140. The cover plate 146 has a series of longitudinally spaced, transversely extending spacer bars 148 secured to the under side thereof so that the holes 142 are not obstructed or blocked.

Mounted within the base section 32 at a location to extend transversely between the side walls 66, and to be spaced about one-half to one inch rearwardly from the doors 48 and 50, is an upper, cool air channel or header designated generally by reference numeral 150. The upper cool air channel 150 includes a forward deflecting plate 152 which slopes downwardly and forwardly in the direction of the doors 48 and 50 so as to deflect air passing through the holes 142 against the rear side of the doors as the air moves downwardly. The upper air channel 150 also includes a bottom plate 154, a back plate 156 and a top plate 158. The described plates which make up the upper air channel 150 are connected to each other to define a hollow enclosure of trapezoidal cross-section as shown in FIG. 7. Opposite ends of the elongated upper air channel 150 open through the side walls 66 into that portion of the air plenum chamber adjacent the side walls. Relatively cool air is thus permitted to circulate through the upper air channel 150 by reason of its communication at its opposite ends with the air plenum chamber. It will be noted in referring to FIG. 7 that the upper air channel 150 projects downwardly from the panel 140 at the upper side of the base section 65 by a distance such that its lower end is lower than the top of the steel rectangular frames **48*a* and 50*a* of the respective doors 48 and 50**.

On the opposite side of the opening to the firebox 65 from the upper side thereof at which the upper air channel 150 is located, a lower air channel or header 160 extends transversely between the opposed side walls 66. The lower air channel 160 communicates at its opposite ends with the air plenum chamber surrounding the firebox 65 at this location in a manner similar to that which characterizes the upper air channel 150. The lower air channel 160 rests upon and is secured to the floor plate 69 of the firebox 65, and extends upwardly therefrom at a location directly to the rear of the doors 48 and 50 and spaced from the doors by a distance of from about one-half inch to about one inch.

The lower air channel 160 includes a vertically extending front plate 162, a bottom plate 164 and a vertically extending rear plate 166. An upwardly and rearwardly sloping top plate 168 is also provided as a part of the lower air channel 160, and the several described plates collectively form a trapezoidal cross-sectional configuration which characterizes the lower air channel. Projecting vertically from the point of intersection of the top plate 168 and the back plate 166 is a deflector plate 170.

In order to aid the reader's understanding of the description which follows, the location within the firebox 65 of a grate 174, supporting a plurality of logs 176 (illustrated in dashed lines) has been portrayed as these appear in their spatial relationships to certain elements of the fireplace system of the invention.

In addition to the upper and lower air channels or headers 150 and 160, a pair of vertically extending lateral air channels 178 and 180 is provided. The lateral air channel 178 and 180 are hollow elements similar to the upper and lower air channels and extend between, and open at their opposite ends to, the hollow interiors of the upper and lower air channels.

At a time when the fire is burning within the firebox 65 and the wooden logs 176 are undergoing combustion, air to support such combustion must be derived from one or a plurality of several locations. Thus, air from outside the house entering the firebox 65 via the duct 106 at a rate controlled by the use of the damper plate 106 can be employed for burning the wood, and closely controlling the rate at which the wood is consumed. Air is also available from outside the firebox as a result of its passage through the small holes 142 provided in the top panel 140, although as will be hereinafter explained, this air plays a relatively minor role in the combustion of wood within the firebox 65, and then only at certain times during operation of the system. As will also be hereinafter explained, the provision of the openings 142, and of the upper and lower air channels 150 and 160 at the locations described, in addition to providing a cooling effect which maintains the doors 48 and 50 at a relatively low temperature, also permits an after-burning effect in which combustible hydrocarbon gases passing upwardly into the stack of the fireplace system, and not completely consumed during the burning of the logs, is combined with oxygen from air in the right proportion to effect the burning of these hydrocarbon gases.

Quite importantly, too, I have found that the current of air passing down along the inner side of the doors 48 and 50 from the openings 142 functions very effectively to prevent the deposition or accumulation of soot and smoke on the rear surface of the glass panels **48*b* and 50*b* forming a part of the doors 48 and 50**, so that these panels are maintained in a relatively clean state, and do not have to be frequently wiped to restore their aesthetic qualities and transparentcy.

Finally, air derived from outside the firebox 65 via the holes 142 can be utilized to sustain a relatively high temperature within the firebox 65 for a very long period of time with better control and less heat loss than can be attained by the use of outside air entering the firebox 65 through the duct 105 when the damper plate 106 is opened. These results will also be hereinafter explained.

Operation

In describing the operation of the fireplace heating system of the invention, it will first be assumed that within the dwelling in which the system is located, a condition prevails initially in which no added heat is required to warm the rooms to the extent desired. In this case, the central heater fan is inactivated by thermostatic control, and no air is pulled from the air plenum chamber through the hot air discharge opening 122 into the duct 128. If a fire is burning in the firebox 65 at this time, the air from the room in which the fireplace is located enters the openings 51 and 53 on opposite sides of the firebox and moves by convective flow to the rear of the firebox, and then upwardly into the central, frusto-pyramidal portion of the housing 10. The air then ultimately moves up into the upper portion of the housing 10 and flows through the opening 30 back into the room in which the fireplace is located.

In traversing this course of flow, the air may be heated to quite high temperatures, typically from 250° F. to 400° F., and is discharged into the room containing the fireplace near the ceiling. It should be pointed out that it is possible to control the temperature attained by this air at this time by the degree to which the doors 48 and 50 at the front of the firebox 65 are closed. In general, completely opening these doors will reduce the temperature of air discharged at this time through the air opening 30, although, of course, this will also result in more of the total heat evolved from the burning wood being discharged through the angulated stack. By contrast, closing the doors 48 and 50 will cause the wood to burn hotter, and more heat will be transferred through the walls of the firebox 65 to air circulated through the air plenum chamber in the manner described.

It is also possible, of course, and is preferred, to control the rate of burning and the heat evolved from the wood by selective control of the outside combustion air which enters the firebox via the duct 105 and the combustion air opening 104. This is accomplished by manipulation of the damper plate 106 through the control linkage 110. As this outside combustion air enters the firebox 65, it is deflected to opposite sides of the firebox and along the bottom thereof by means of the air diverting plate 109. Very close and flexible control of the heat transferred through the firebox walls can be attained by a combination of control of the amount and velocity of outside combustion air admitted to the firebox 65 through the rear thereof via the combustion air opening 104. This control is explained in greater detail hereinafter. The fireplace system of the invention has the great advantage of deriving most of the combustion air from outside the dwelling where it is of low carbon dioxide content, but much more importantly, the draft of already heated air from inside the living room or other space where the fireplace is located is reduced, and there is concurrently a substantial reduction in the heat loss through the stack. On the other hand, combustion air derived from outside the dwelling will frequently be very cold, and this will detract slightly from the total maximum temperature which might otherwise be attainable over extended periods of burning. The present invention takes account of this in a manner hereinafter described.

Assuming next that the temperature within the rooms of the home in which the system is located has dropped below the thermostated temperature level which is desired, the thermostatic control then functions in one of two ways, depending upon the temperature of the air in the air plenum chamber. If this air has not yet been heated to a pre-selected temperature sufficiently high to warm the rooms as needed, the thermostatic control turns on the conventional gas or electric heater provided with the conventional central heating furnace to warm the air moving in the central heating ducting system sufficiently that upon distribution, the rooms will be adequately warmed to reach the required thermostated temperature. If, on the other hand, the fireplace has been in use for a sufficient period of time that the air within the air plenum chamber has become heated to a level sufficient to provide the necessary warming in the remote rooms (typically between about 150° F. and 215° F. at the source in the air plenum chamber), this air alone will be adequate to warm the rooms as needed, and the gas or electric heating devices in the conventional central heating furnace are not activated, thereby effecting a substantial savings in heating costs, and maximizing the efficiency with which the thermal energy of the burning wood is recovered.

When the heated air from the air plenum chamber is being passed through the hot air discharge opening 122 and duct 128 into the central heating system of the house, the discharged hot air consists of a mixture of air drawn in through the upper air opening 30 and air which enters the forward side of the base section 32 of the system via the horizontally spaced openings 51 and 53. It will be perceived that with respect to air which enters the opening 51, this air has little time to become heated before it reaches the hot air discharge opening 122 due to the relatively close proximity of these openings and the direct path of travel between them. In contrast, air which is drawn in through the air opening 30 at the top of the housing 10 must pass down along the stack and into the space at the rear of the firebox 65, and from thence around to that side of the housing 10 in which the hot air discharge opening 122 is located. This air therefore has an opportunity to become highly heated. It will be noted, however, that this air is diluted and is blended with relatively cooler air which is entering the opening 53 on the opposite side of the firebox, and must flow around the firebox to the rear thereof and to the opposite side of the firebox before reaching the heated air discharge opening 122. Moreover, the horizontally extending baffle plates 120 and 121 assure that the main portion of the cool air entering openings 51 and 53 will not ascend by conduction, but will instead flow directly towards the hot air discharge opening.

I have determined that the spatial arrangement of the several air openings 30, 51 and 53, in conjunction with the provision of the interposed horizontally extending baffle plates 120 and 121 and the vertically extending baffle plate 124, assures that the relatively cool air entering through the openings 51 and 53 is always adequate, when mixed with the relatively hot air which enters the plenum chamber through the opening 30, to prevent the air mixture discharged through the heated air discharge opening 122 from exceeding a temperature of about 250° F. This feature of the relative spacing of the air openings 51, 53 and 30, considered with the areal size of the openings and the baffling system which is provided between the several openings, coupled further with the location of the hot air discharge opening 122, assures that the air which is pulled through this opening by the central heating system fan will never reach a temperature level which constitutes a fire hazard or danger to the house.

It should be pointed out that once the wood is burning vigorously, the length of time which it will burn, and the temperature level which it will attain during burning, and thus the amount of heat transferred through the walls of the firebox 65, can all be closely controlled by the use of the damper plate 106 and the glass doors 48 and 50. Even when the wood is made to burn the hottest by selective positioning of these structures, however, the air being discharged through the heated air discharge opening 122, as a result of the described dilution effect, will not attain an unsafe temperature.

In repeated testing of the heating system of the invention, I have found that the system, through its structural makeup, affords excellent heat control and heat utilization in several modes of operation.

At the time when a fire is first started in the firebox by ignition of the logs 176, it is desirable that a substantial amount of combustion air be provided to support the combustion and to assure that the logs are rapidly and thoroughly ignited. At this time, it is often desirable to open the damper plate 106 to its full open position so that a maximum amount of outside combustion air is drawn into the fireplace by the draft created upwardly through the flue pipe 96. Often at this time, the fire builder is still observing the fire and perhaps rearranging the logs for best burning effect. In any event, it will be assumed that at this time, the doors 48 and 50 at the forward side of the firebox are opened. Whether they are open or not at this time during the use of the heating system, the logs 176 commence to burn vigorously as they are provided with adequate and usually excess combustion air from the outside of the dwelling.

Tests have indicated that as the logs commence to burn more and more vigorously, the temperature within the firebox rises to a certain level, and then stabilizes and no further temperature increase occurs. Typically, the temperature, as measured by a suitable pyrometer or thermocouple at a location behind the aloping front wall 74 of the lower stack section 70 will be around 400° F. to 475° F. at this time. This temperature will be maintained as long as the damper plate 106 is retained in its full open position, or is largely open so as to provide sufficient combustion air from outside the dwelling to sustain combustion at a rate which is the maximum attainable with the particular fuel being burned.

At this time, if the doors 48 and 50 are open, additional air to sustain combustion will be drawn from inside the room where the fireplace is located. From a standpoint of thermal energy conservation, this is undesirable since an adequate supply of combustion air can be drawn from outside the dwelling through the duct 105. Many persons, however, enjoy the aesthetics of the open fire and prefer to leave the doors 48 and 50 open while they are sitting before the fireplace and enjoying the radiant heat from the blazing logs.

In order to prevent thermal energy from being lost from inside the dwelling, however, and also to intensify the heat generated within the firebox, it is preferable to close the doors 48 and 50 once the logs are well ignited and are burning vigorously. Closure of the doors 48 and 50 reduces the total supply of air to the burning logs, prevents heat from being lost from the interior of the dwelling up the flue pipe 96, and results in a slight further increase of the temperature within the firebox 65 as generated by the burning logs. The slight increase of the temperature at this time is a result of reduction in the rate of flow of air up through the flue pipe 96 so that heat does not move to the outside of the dwelling as rapidly by this path. Reduction in the velocity of air flow up the stack and out the chimney to achieve further increase in the maximum attainable temperature within the firebox is also attained by throttling down the intake of air from outside the dwelling via the duct 105 by partial closure of the damper plate 106.

During the time when combustion air is being predominantly derived from the outside of the dwelling via the duct 105, the small amount of air entering the firebox by way of the holes or apertures 142 formed through the elongated panel 140 at the upper front side of the firebox flows downwardly in a substantially vertical curtain along the inner side of the doors 48 and 50. Air first passes through that space which is provided between the upper cool air channel or header 150 and the inner side of the doors 48 and 50, and then continues to move downwardly in a vertical curtain along the rear side of the glass panels 48*b* and 50*b* forming a portion of each of the doors 48 and 50. The geometry and stability of this curtain is maintained by the relatively hot zone of combustion gases and air immediately over, and radiating outwardly from, the logs 176, coupled with the momentum of the incoming cooling air resulting from the draft or partial vacuum existing within the fireplace. Whatever the total causes of the existence of the moving air curtain adjacent the rear doors 48 and 50 may be, I have determined through smoke tests that the curtain remains stable of this location, and that the incoming air flowing through the holes or apertures 142 moves downwardly immediately to the rear of the inside of these doors all the way from the elongated panel 40 to a location which is within that space defined between the vertically extending front plate 162 of the lower cool air channel 160, and the inner side of the doors. Upon reaching this location, the relatively cool air reverses direction and responds to the upward draft within the firebox as developed by the flow of combustion gases and heated air upwrdly into the stack and flue. In undergoing such response, the cooling air direction of flow is reversed, and it moves upwardly across the upwardly and rearwardly sloping top plate 168 of the lower cool air channel or header 160. It then strikes and is slightly deflected by the deflector plate 170, and continues to move upwardly into the lower stack portion 70.

It will be noted that at this time, the relatively cool air which enters the firebox from the holes or apertures 142 does not afford any significant support for the combustion of the logs 176 which are being burned through the use of combustion air entering the firebox from the duct 105. It should be pointed out, however, that this air originating from the holes 142 is relatively high in oxygen content, as compared to the gases and oxygen-depleted air immediately over the logs, and in the lower portion of the lower stack portion 70. This air therefore, given a sufficiently high temperature at this location within the system, can initiate and support secondary combustion or an afterburning effect resulting in the burning of combustible hydrocarbon gases being carried upwardly into the stack by convection with the hot products of combustion of the logs. This is a very desirable effect in that discharge of incompletely burned materials into the atmosphere is reduced, and a greater portion of the total BTU content of the burning logs is recovered by this afterburning or secondary combustion effect.

Another important function of the air which enters the holes 142 is the cooling effect which it afford with respect to the doors 48 and 50. Tests have shown that the temperature immediately adjacent or contiguous to the inner sides of the doors 48 and 50, when the curtain of cool air is flowing in the manner described, is about 150° lower than that which obtains a distance of only two inches further inwardly within the firebox; that is, on the opposite side of the cooling air curtain at this location. The curtain of cool air thus aids substantially in reducing the temperature of both the metal rectangular frames 48*a* and 50*a* and the glass panels 48*b* and 50*b* making up the doors 48 and 50 sufficiently that they are no more than uncomfortable to the touch, and serious burns by contact therewith are completely avoided.

A further important aspect of the provision of the moving air curtain immediately to the rear of the closed doors 48 and 50 is that smoke accumulations and soot deposits which are characteristically experienced on the inner surfaces of such fireplace doors is largely obviated. Without provision of this feature of the present invention, and in conventional fireplace systems which use closed glass doors at the opening to the firebox, smoking of the glass occurs over a period of as few as two or three uses of the system, and the glass must be very frequently cleaned. The moving air curtain which I have provided in the system of this invention, however, eliminates such smoke deposition on the glass altogether, and at worst in heavy usage of the system, reduces the need for cleaning the glass to perhaps twice during each winter season.

At a time after the logs 176 are burning vigorously, maximum heating within the firebox can be obtained by completely throttling or closing off the combustion air supply from outside the dwelling via the duct 105, or very substantially reducing this flow of outside combustion air. The reason for the very significant increase of temperature within the firebox 65 at this time is that there is less velocity of flow of hot air upwardly through the stack, and the relatively slow movement of heat out of the firebox and to the atmosphere via the stack assures that the air has time to become more highly heated before leaving the system in this fashion. Moreover, the wood has an opportunity to burn hotter and more completely with a restricted supply of low velocity combustion air which is nevertheless adequate to easily support combustion and maintain the burning of the logs.

To this end, and because of the provision of the holes 142 as a source of air, it is possible to elevate the temperature of the air within the lower portion 70 of the stack to as high as about 650° F. It will be readily perceived that when the air and combustion gases at this location are heated to this temperature, very excellent heating of the air in the air plenum chamber is also obtained. In fact, with the fire within the firebox 65 controlled in this fashion to elevate the temperature therein to the maximum, an entirely adequate supply of hot air derived from the air plenum chamber and discharged into the ducting system of the dwelling via the duct 128 is constantly available, and in most cases will approach and reach that which is necessary to heat all of the rooms of the dwelling to the temperature desired. In this case, the system can be thermostatically controlled so that withdrawal of air from the air plenum chamber through the duct 128 is briefly terminated, and the hot air within the air plenum chamber permitted to discharge through the opening 30 at the upper side thereof.

If the room in which the fireplace is located, and all of the other rooms in the dwelling, become uncomfortably warm during this mode of operation, the damper plate 106 may again be opened substantially to permit relatively cold outside air to the drawn rapidly into the firebox to consume the wood at a faster rate, but to also remove more of the heat generated by the burning of the wood upwardly through the stack and flue to the atmosphere. After employment and usage of the fireplace several times, the user will, of course, gain an understanding of how much fuel should be used, and how best to control the dampering system to achieve the maximum thermal efficiency in terms of heating the house, without overheating, and to combine this with the maximum aesthetic effect derived from having the wood burn brightly and fiercely at times, and from opening the doors 48 and 50 at the front of the firebox when desired.

It should be pointed out that a further advantage of the provision of the holes 142 in the elongated panel 140, and the concomitant supply of a small amount of air from this source, is that at such time as the inhabitants of the dwelling where the system is located desire to retire for the evening, the wood may be permitted to burn to where a substantial part of it has been consumed, and at this time, the damper plate 106 may be completely closed so that the holes 142 constitute the sole source of air. With the system in this status and the doors 48 and 50, of course, closed at this time, the air stream which curtains the inner side of the doors is then drawn back up over the upper edge of the deflector plate 170 of the lower cool air channel 160 and into the burning logs 176 to provide the necessary combustion air to support slow, continuous burning. This limited volume combustion air is supplied relatively slowly due to the limited capacity of the holes 142 to admit air, and the result is that the logs continue to burn hotly but slowly throughout the night. The same is true of the coals which remain as the logs are consumed. I have found that the effect of continuing to slowly burn the logs with this system of a finely controlled combustion air source enables burning to be continued at a high, uniform heat level over a very extended period of time. For example, four or five average firewood logs and the coals therefrom can be made to burn for a period of nine hours while developing a fairly even temperature of about 500° F. in the lower portion of the stack.

Cooperating with the cool air curtain described in providing a protective and cooling function for the doors 48 and 50 are the cool air channels or headers 150, 160, 176 and 178. As has been previously pointed out, these air channels communicate with the air plenum chamber defined between the outer housing and firebox. Further, it will be perceived in referring to the drawings, and particularly to FIGS. 1, 4 and 7, that the locations at which the upper and lower air channels open into the air plenum chamber are very close to the upper portions of the openings 51 and 53 formed at the forward side of the base section 32. Relatively cool air from the room into which the fireplace opens is entering these openings 51 and 53 at this location, and thus is free to circulate through the upper air channel 150 from one side of the firebox to the other. There is thus a relatively cool body of air carried on the interior of this air channel which is interposed between the hot combustion gases, generated by the burning logs, and the doors 48 and 50. Moreover, this air channel is disposed at a location such that it protects the rectangular metal frames of each of the doors 48 and 50 at this location from the radiant heat of the fire, as well as heat reaching the door frames by convection.

Substantially the same function is characteristic of the lower cool air channel 160 which extends across the firebox and communicates at its opposite ends with the air plenum chamber. The openings to this cool air channel are also immediately adjacent the openings 51 and 53 formed in the forward side of the base section 32, and thus relatively cool air is enabled to flow through this channel from one side of the firebox to the other. The lower portions of the metallic frames of the doors 48 and 50 are thus protected by this air channel from radiant heat and from heat conveyed thereto by convection.

From the foregoing description of the invention, it will be apparent that the present invention provides a highly useful, energy efficient fireplace heating system for heating homes and other edifices. The system is very safe to use because it automatically prevents attainment of heated air temperatures which constitute a fire hazard. Moreover, it automatically responds to and supplements the central heating system, and indeed, replaces it altogether at times when a wood fire is burning vigorously in a firebox forming a part of the system.

Although a preferred embodiment of the invention has been herein described in order to illustrate the principles of the invention, it will be understood that various changes and innovations can be effected in the described structure without departure from the basic principles which underlie the invention. Changes and innovations of this type are therefore deemed to be circumscribed by the spirit and scope of the invention except as the same may be necessarily limited by the appended claims or reasonable equivalents thereof.

What is claimed is:

1. A fireplace heating system comprising:

a firebox having opposite side walls, a back wall extending between said side walls and an open front side spaced from and opposite said back wall;

an angulated stack connected to the firebox at the upper side thereof and extending generally upwardly from the firebox, said stack having a lower portion, a central portion projecting vertically from said lower portion, and an upper portion extending upwardly and rearwardly in the direction of the back wall of the firebox from said central portion;

housing means around the firebox and stack and defining with the firebox and stack an air plenum chamber, said housing means including:

an upper portion surrounding, and spaced from, the upper portion of said stack and having an upper air opening at the forward, top side of said upper portion and spaced upwardly from the open front side of said firebox, said upper air opening being positioned opposite said upper portion of said stack; and a base portion including:

a bottom wall;

side walls spaced horizontally from the side walls of the firebox to define a portion of said air plenum chamber, one of said side walls having a hot air discharge opening therethrough adjacent and above said bottom wall, said hot air discharge opening being aligned with the lowermost portion of said firebox and adapted for connection to a forced air device; and a back wall spaced horizontally rearwardly from the back wall of the firebox and interconnecting the side walls of said base portion, said space between said base portion back wall and the back wall of the firebox forming a portion of said air plenum chamber;

said base portion having horizontally spaced lower air openings in horizontal alignment with the open front side of the firebox and on opposite sides of said firebox opening, said lower air openings each being disposed substantially closer to said hot air discharge opening than said upper air opening, and each of said lower air openings opening in the same direction as the open front side of the firebox for receiving relatively cool air from a room into which said firebox opens; and a central portion positioned between and interconnecting said housing means upper portion and said housing means base portion, and surrounding and spaced from said lower portion of said stack, said central portion of said housing means being disposed between said upper air opening and said hot air discharge opening;

baffle means in said air plenum chamber and disposed between said upper air opening and said hot air discharge opening for directing air entering said air plenum chamber from said upper air opening in a circuitous elongated path, including a portion of said path extending in a horizontal direction around said firebox, en route to said hot air discharge opening, said baffle means, hot air discharge opening, upper and lower air openings all cooperating to proportionately mix air from the upper and lower air openings to optimize the temperature of such mixed air at the time of its discharge through said hot air discharge opening; and means for selectively closing to a desired degree the open front side of said firebox to control admission of combustion air to the interior of said firebox from the open front side thereof.

2. A fireplace heating system as defined in claim 1 and further characterized as including means in the back wall of the firebox and the back wall of said housing base portion for admitting combustion air to the rear lower portion of said firebox.

3. A fireplace heating system as defined in claim 1 wherein said baffle means comprises:

a first horizontal plate extending between a side wall of the firebox and a side wall of said housing base portion for directing air flow horizontally and rearwardly in said air plenum chamber and alongside said firebox;

a second horizontal plate extending between a second side wall of the firebox and a second side wall of said housing base portion for directing air flow horizontally and rearwardly in said air plenum chamber and alongside said firebox.

4. A fireplace heating system as defined in claim 2 wherein said combustion air admission means comprises:

opening means in the back wall of said firebox;

a duct connected to said opening means and extending through said housing back wall; and means for controlling the flow of air into said firebox via said duct and opening means.

5. A fireplace heating system as defined in claim 3 wherein said baffle means further includes a vertically extending baffle plate positioned between the back wall of said base portion and the back wall of said firebox.

6. A fireplace heating system as defined in claim 1 wherein said means for selectively closing the open front side of said firebox comprises a pair of transparent glass doors pivotally mounted on said housing adjacent said firebox.

7. A fireplace heating system as defined in claim 1 and further characterized as including a central heating duct system connected to said hot air discharge opening.

8. A fireplace heating system as defined in claim 1 wherein said angulated stack comprises:

a frusto-pyramidal lower stack portion positioned over said firebox and communicating with the interior thereof;

a central stack portion connected to said lower stack portion and extending upwardly therefrom; and an upper stack portion connected to said central stack portion and projecting upwardly and rearwardly therefrom in a direction away from said upper air opening and having a front wall in direct alignment with said upper air opening.

9. A fireplace heating system as defined in claim 3 wherein said first and second horizontal plates are in substantially coplanar alignment in a plane spaced vertically from said bottom wall and above said hot air discharge opening.

10. A fireplace heating system as defined in claim 9 wherein said baffle means further includes a vertically extending baffle plate positioned between the back wall of said base portion and the back wall of said firebox, and extending through the plane containing said first and second horizontal plates.

11. A fireplace heating system as defined in claim 2 wherein said means for selectively closing the front side of said firebox comprises:

at least one door pivotally connected to said housing means for pivoting to a position of closure across the open front side of said firebox and including:

a metallic frame; and a glass panel mounted in said frame; and means for curtaining the inner side of said doors, when closed, with a curtain of relatively cool air interposed between said doors and the interior of said firebox.

12. A fireplace heating system as defined in claim 11 and further characterized as including air channel means adjacent said metallic door frames and cooperating with said air plenum chamber for conveying air within said channel means across the open front side of said firebox at locations immediately adjacent and interiorly from the metallic frames of said doors to prevent direct exposure of said door frames to the heat of combustion of fuel in said firebox.

13. A fireplace heating system as defined in claim 11 wherein said curtaining means comprises:

an elongated, horizontally extending panel forming a portion of said housing means and located over the open front side of said firebox, said elongated panel having a plurality of spaced holes therethrough communicating with the interior of the firebox and positioned immediately inwardly from said doors when the doors are in their closed positions, and means for deflecting air passing through said holes into a curtain of air which extends substantially parallel to said glass panels.

* * * * *